United States Patent [19]

Thompson

[11] 4,091,626

[45] May 30, 1978

[54] TRENCH SHORING MACHINES

[76] Inventor: Alistair Nigel Thompson, 20 Farfield Avenue, Knaresborough, Yorkshire, England

[21] Appl. No.: 752,613

[22] Filed: Dec. 20, 1976

[30] Foreign Application Priority Data

Dec. 24, 1975 United Kingdom ..... 52822/75

[51] Int. Cl.[2] ..... E21D 5/12

[52] U.S. Cl. ..... 61/41 A; 61/85

[58] Field of Search ..... 61/41 A, 85, 105, 41, 61/84

[56] References Cited

U.S. PATENT DOCUMENTS 3,916,629 11/1975 Thompson ..... 61/41 A 3,967,454 7/1976 Barnes ..... 61/41 A 3,994,139 11/1976 Folk ..... 61/41 A

*Primary Examiner*—Jacob Shapiro

*Attorney, Agent, or Firm*—Stevens, Davis, Miller & Mosher

[57] ABSTRACT

A trench shoring machine comprises front and rear frameworks movable forwardly relative to each other and a series of longitudinally extending piles arranged along each side of the frameworks and movable longitudinally and independently of the frameworks. The piles are provided with rearward extensions which are laterally spaced from side elements of the rear frameworks so that lining members may be located between said rearward extensions and said elements to shore the trench sides after advance of the piles.

12 Claims, 14 Drawing Figures

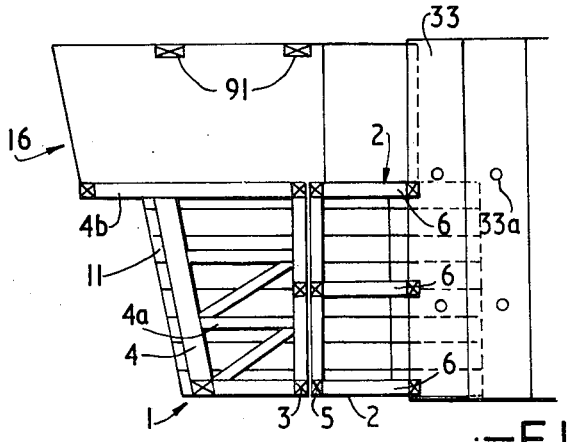
-FIG.1-
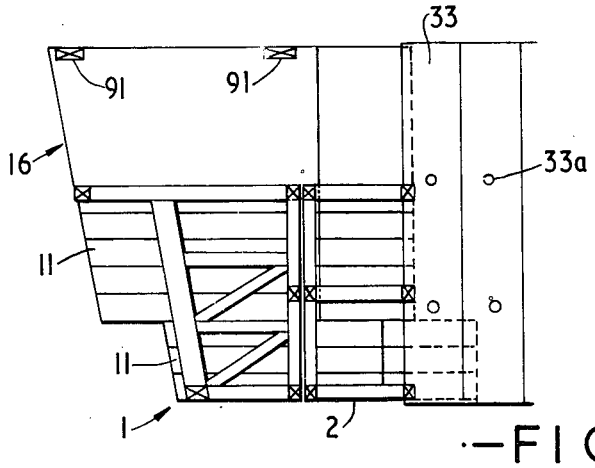
-FIG.2-
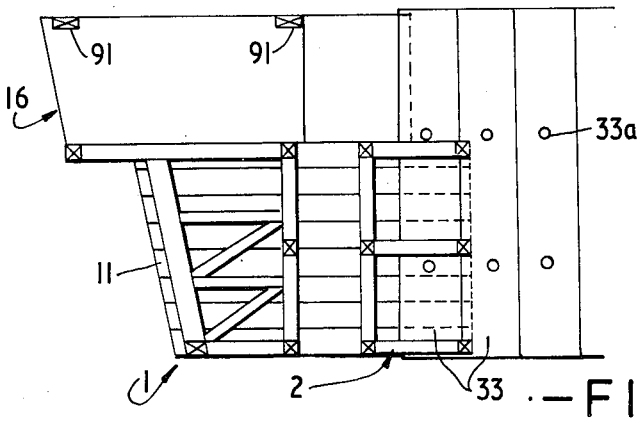
-FIG.3-

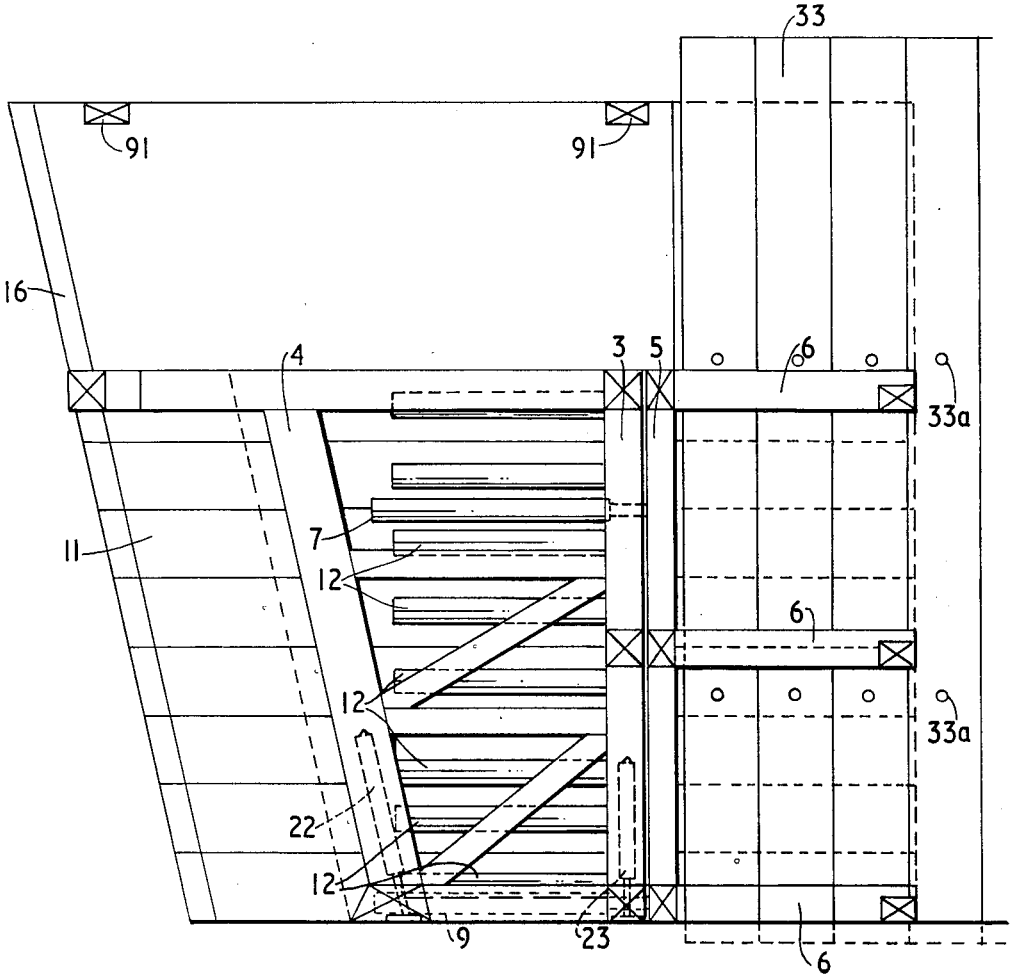
—FIG.4—
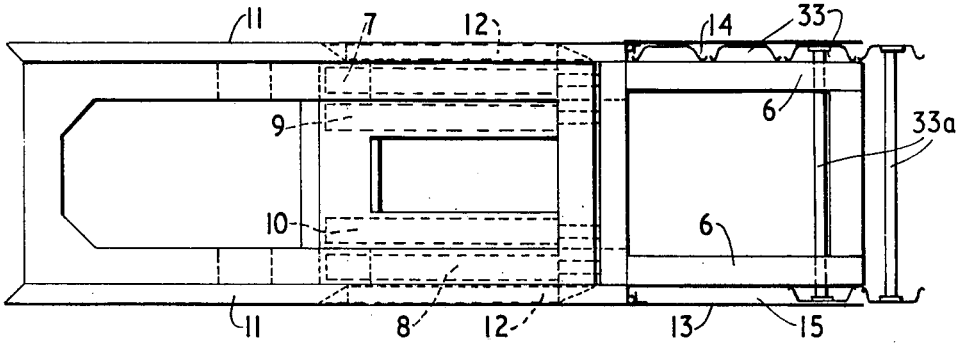
—FIG.5—

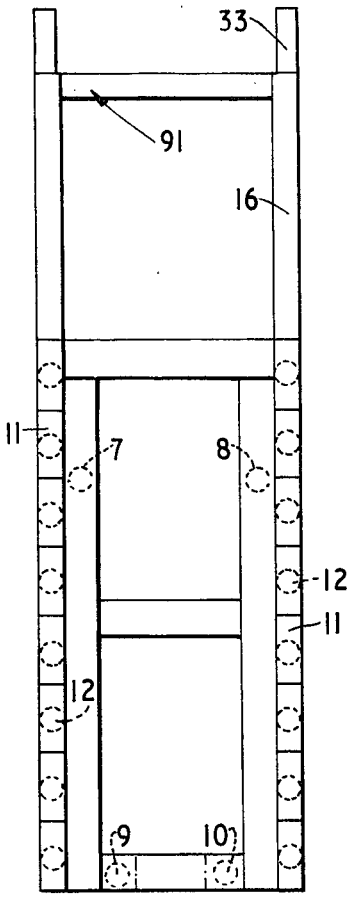
-FIG.6-
-FIG.8A-
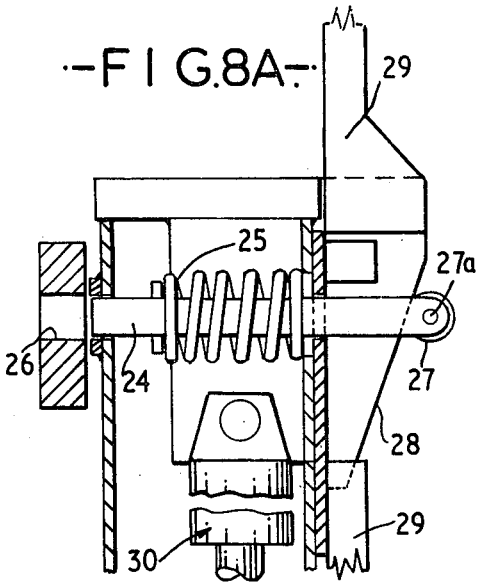
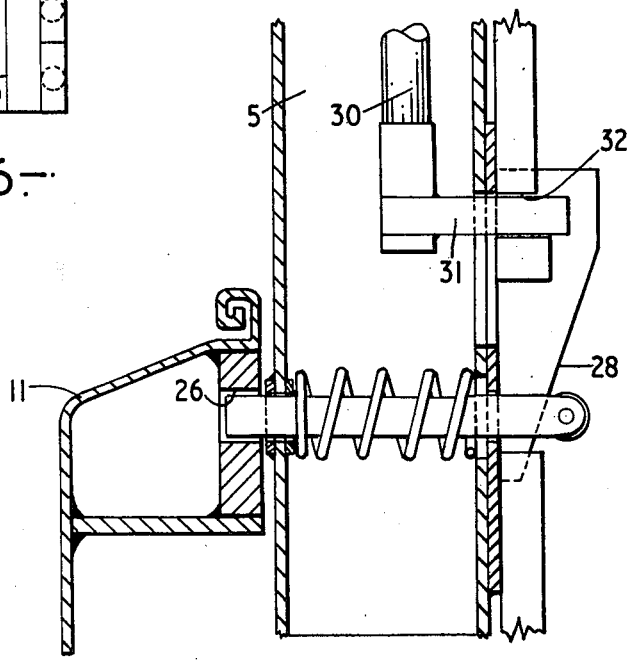
-FIG.8B-

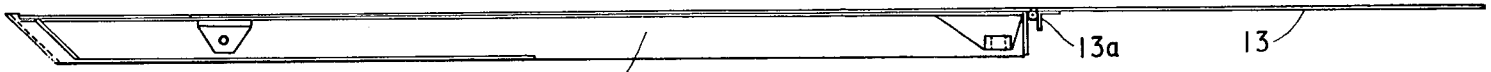
-FIG.7.-
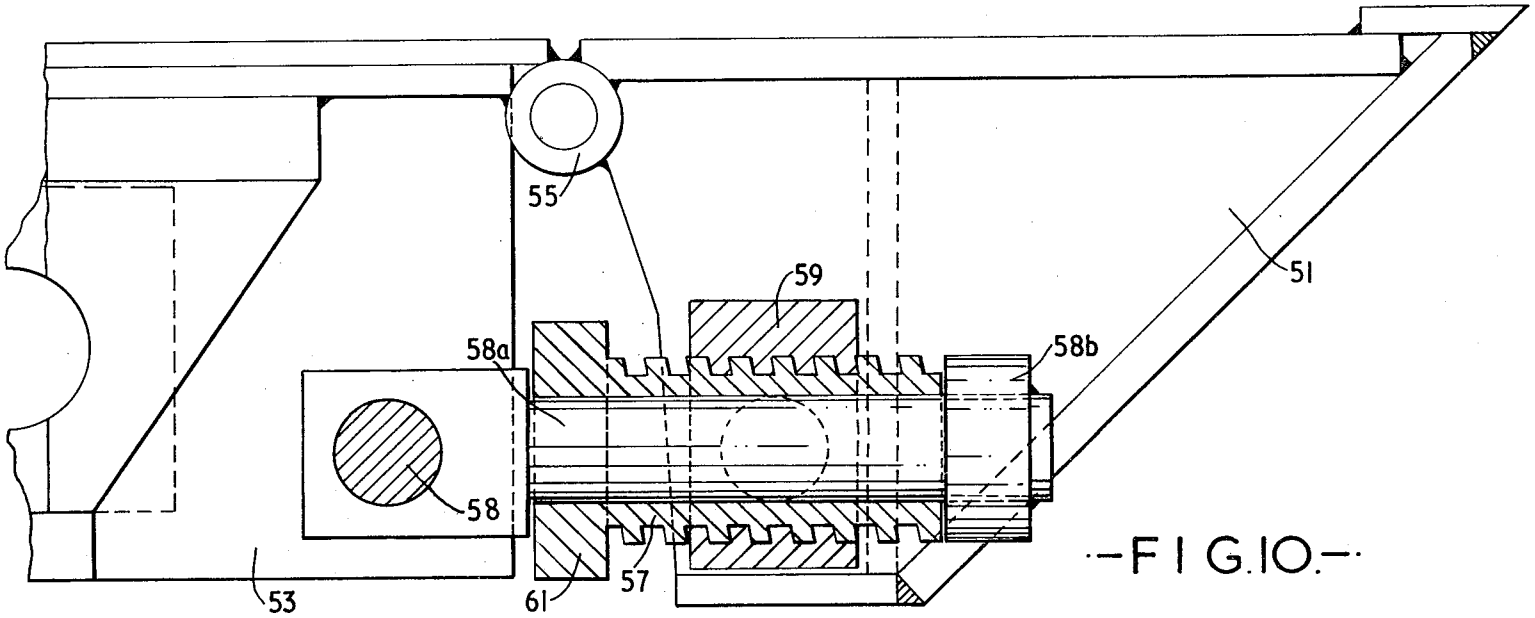
-FIG.10.-

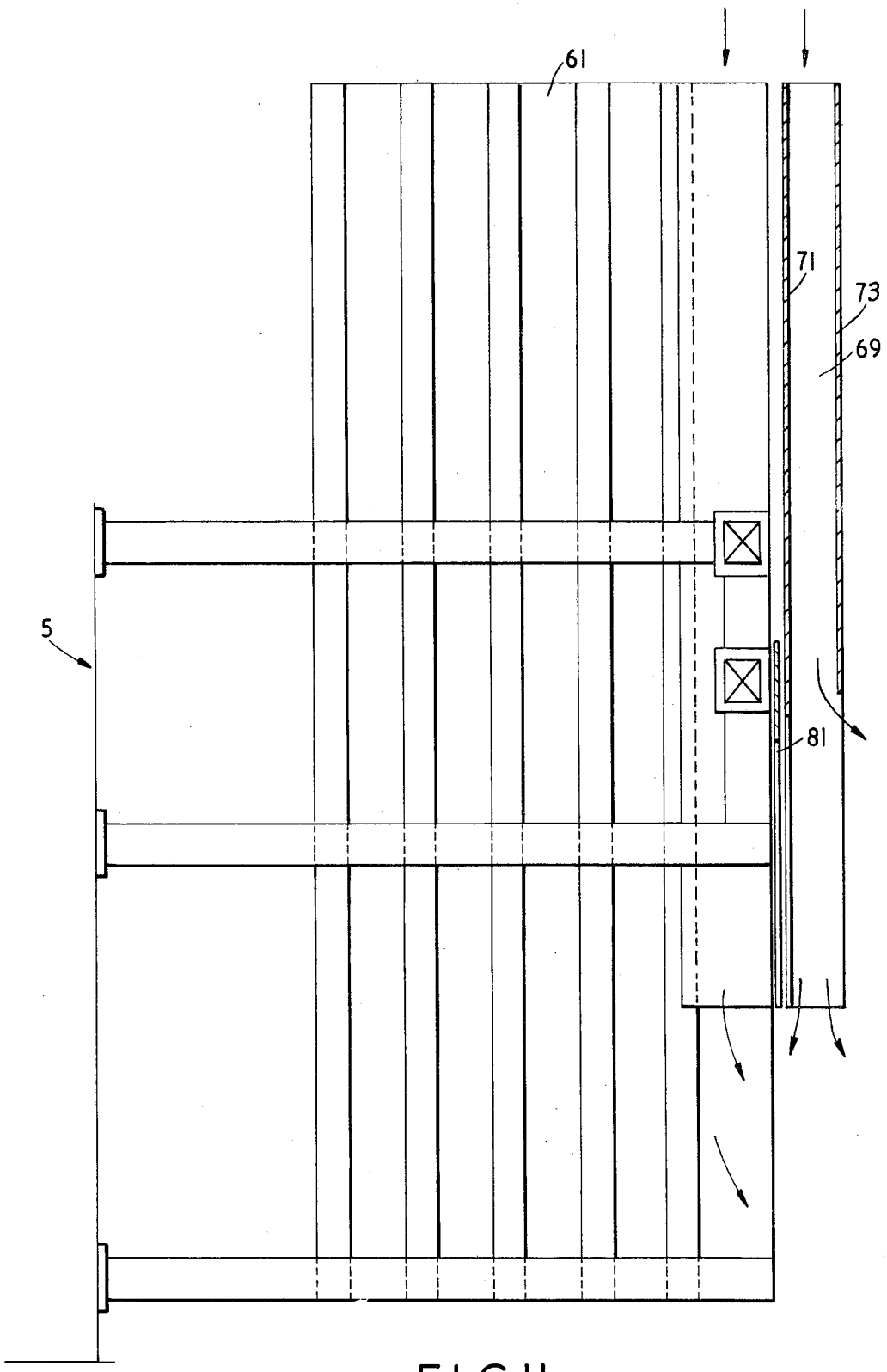
-FIG.11-

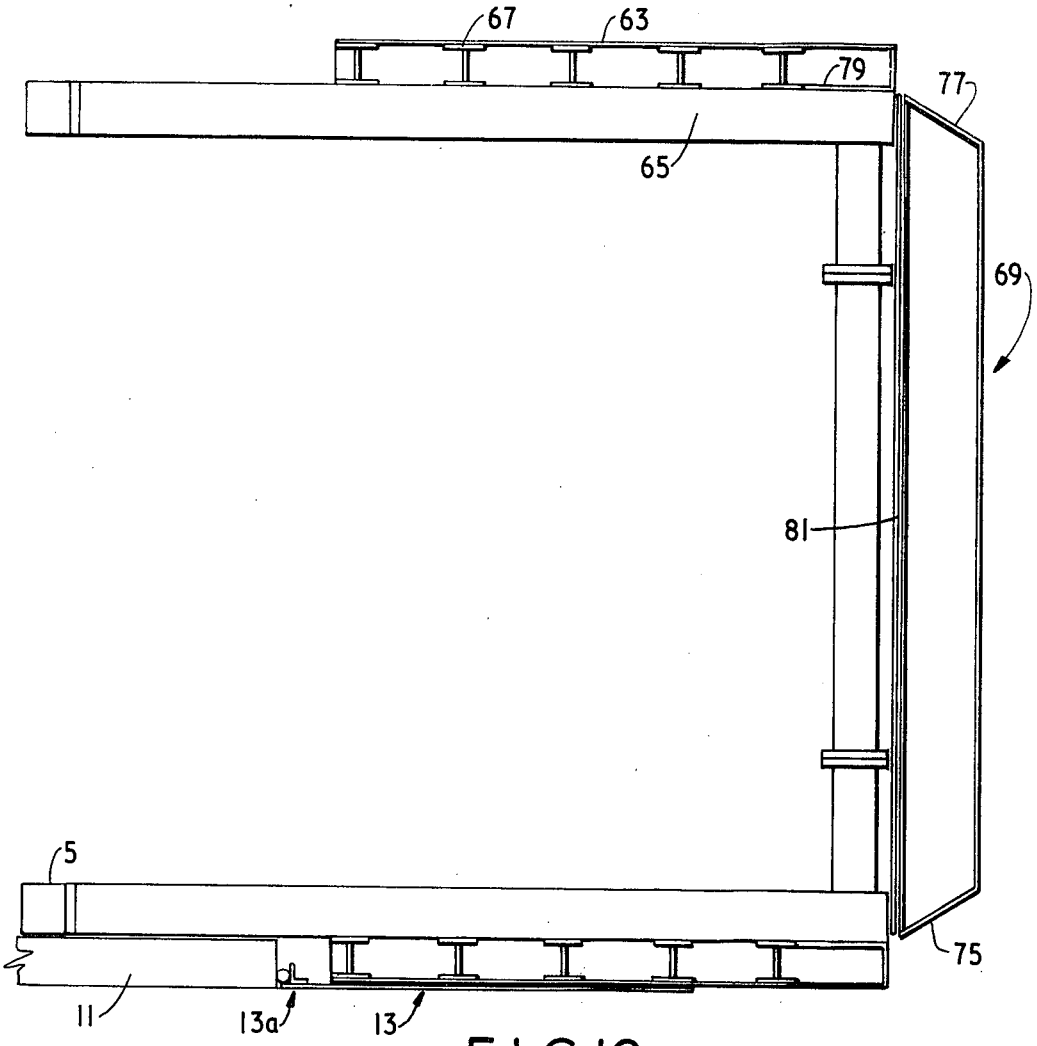
-FIG.12-

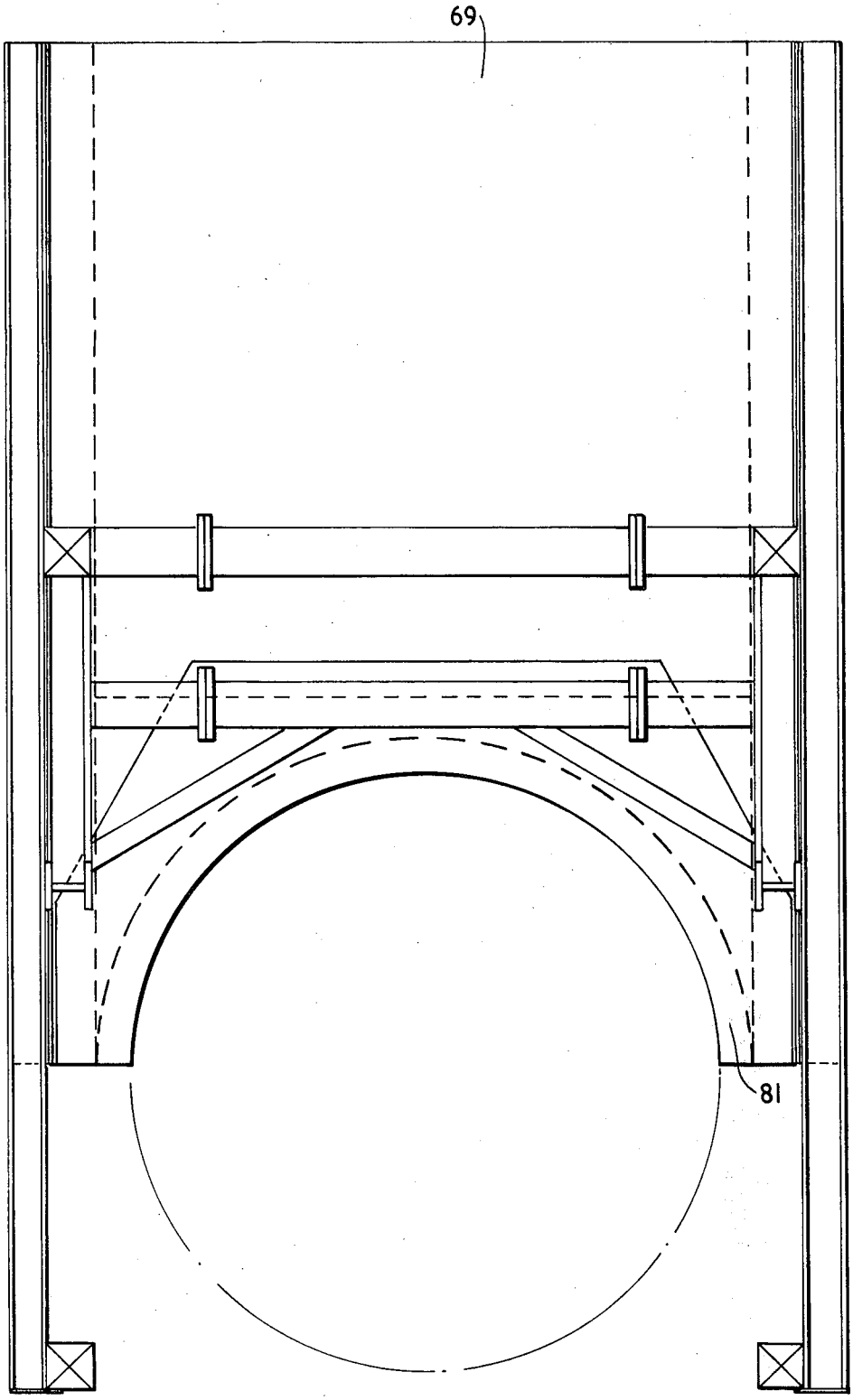
-FIG.13.-

TRENCH SHORING MACHINES

This invention relates to trench shoring machines.

U.K. patent application No. 5796/73 describes and claims a trench shoring machine comprising a framework, a series of longitudinally extending vertically spaced piles arranged along each side of the framework, guide means guiding the piles for substantially horizontal sliding movement longitudinally of the framework, drive means for longitudinally advancing the piles with the framework held stationary, and holding means for holding the piles in their advanced positions and advancing the framework relative to the piles.

In operation, with the framework positioned in a section of a trench, the framework is held stationary and the piles are longitudinally advanced relative to the framework, the piles cutting into fresh ground ahead of the framework. The piles are preferably advanced independently and in sequence, the other piles being held in position relative to the framework and the frictional engagement of these other piles with the trench walls serving to hold the framework stationary. When all the piles have been advanced and the soil or other material dug from between the two sets of piles the piles are held in their advanced position and the framework is moved forward relative to the piles. A further sequence can then commence. Advance of a pile or plurality of piles is effected against the remaining held piles, the backfill never being used as a bearing surface. The use of a series of horizontal piles for shoring a trench side, rather than a single shield, makes this possible, as the piles can be advanced singly or in groups rather than attempting to advance the whole depth of a side-supporting shield at once.

The present invention is concerned with a modified form of such a trench shoring machine which facilitates the positioning of lining members along the walls of the trench as they are cut so enabling the trench, or at least a section of trench behind the piles, to be kept open after the cutting machine has advanced. Work behind the piles can thus be effected after cutting rather than attempting to work within the confines of the piles and in some cases this is highly advantageous. Thus, by working outside the confines of the piles, the workmen are not exposed to the dangers inherent in working close to an open face of excavation. Such an open face may involve about 7 meters of vertical ground and any collapse or fall could be highly dangerous.

According to the present invention a trench shoring machine comprises a front framework, a rear framework, a first drive means acting between the two frameworks for causing longitudinal advance of each framework relative to the other, a series of longitudinally extending vertically spaced piles arranged along each side of the frameworks, guide means guiding the piles for substantially horizontal sliding movement longitudinally of the frameworks, second drive means for advancing the piles longitudinally relative to the frameworks, means for locking the piles to each framework to prevent movement of the piles relative to that framework, and rearward extensions of the piles, said rearward extensions being laterally spaced from side elements at the respective sides of the rear framework to delineate spaces for receiving lining members to shore to the trench sides after advance of the piles.

By working behind the piles, the trench bed can be cleared up behind or within the rear frame while the forward part of the machine is moving and accordingly there is no need to stop the operation of the machine while the bed is being prepared.

In one embodiment in accordance with the present invention, the machine is not itself provided with integral lining members to be accommodated in said spaces, said spaces being for receiving vertically extending lining members to shore the trench sides after advance of the piles.

In this case the work within the trench, e.g. pipe laying, can be effected outside the confines of the machine and in some cases this is highly advantageous. In use, with the rear framework in its advanced position relative to the front framework, and locked in that position, the piles are longitudinally advanced relative to the frameworks to cut into fresh ground ahead of the frameworks. The piles are preferably advanced independently and in sequence, all other piles being held in their advanced or retracted positions relative to the front framework, and the frictional engagement of those other piles, together with the relative locking of the two frameworks, serving to hold the frameworks stationary. With all the piles advanced and locked to the rear framework, there are spaces delineated between the rearward extensions of the piles and the respective sides of the rear framework at each side of the trench and vertical lining members can be fitted into the spaces to shore the walls of the trench.

During the process of inserting the lining members the soil or other material may be dug from between the two sets of piles, and the front framework advanced to its forward position relative to the rear framework, the reaction force being taken by the piles in frictional engagement with the walls of the trench. The front framework is then locked to the piles and the rear framework advanced up to the front framework. The machine is then ready to start a new sequence of movement, the first stage involving the advance of the piles to cut into fresh ground, the further stages described above then being repeated.

The walls of the trench are safely shored behind the machine as it advances by the vertical lining members and work can thus be carried out in the trench behind the machine.

In another embodiment in accordance with the present invention, the sides of the rear framework have each attached thereto one or more lining members to shore the trench sides after advance of the piles. In this case the work within the trench takes place within the confines of the machine but rearwardly of the piles and equipment associated therewith. In other respects the operation of the machine is as described above for the first embodiment of the invention.

The piles for a trench shoring machine in accordance with the present invention are each provided with a forward cutting edge. The forward end of each pile may be integral with the rest of the pile or, alternatively, it may be mounted on the pile for pivotal movement relative to the rest of the pile and about a vertical axis.

Preferably both the first and the second drive means are hydraulically operated rams. Locking of the two frames in their relatively advanced or relatively retracted positions can then be effected by hydraulic locking of the rams forming the first drive means. Locking of the piles in their retracted and advanced positions relative to the frameworks can also be effected hydraulically. Preferably a mechanical locking arrangement is also provided for locking the piles to the rear framework when the piles are in their advanced position. Such locking means may comprise bolts spring loaded into a locking position where they may engage locking holes on the individual piles, together with mechanical means for releasing the locks by retracting the bolts against the spring biasing force.

The machine may be made in three sections, a lower section and a middle section which are preferably bolted together and have their own independent drive means, and a top section which can be pinned or otherwise simply secured to the middle section. The lower section may be used on its own for a relatively shallow trench, the middle and/or top sections being added for deeper trenches. Furthermore, when working in relatively deep trenches, the top section of the machine may be removed when trenching in the vicinity of cables or pipes that are close to the surface of the ground, thereby allowing the middle and lower sections of the machine to cut beneath such cables or pipes. If more deeply buried obstructions are encountered the middle section may also be removed. Alternatively the machine may be in two sections, a lower main section including the drive means and the locking means, and a top section pinned or otherwise secured to the lower section. Either arrangement again increases the versatility of the machine. In either case the removable top section may be arranged to be moveable forwardly with the top pair of piles of the main section or sections of the machine or, alternatively, may be arranged to be moveable forwardly with the front framework of the main section or sections.

Embodiments of the present invention will now be described, by way of examples only, and with reference to the accompanying drawings, in which:

FIGS. 1 to 3 are schematic side elevations of a first embodiment of the machine in different stages of operation;

FIGS. 4, 5 and 6 are, respectively, schematic sectional elevation, plan and front elevation views of the machine of FIG. 1;

FIG. 7 is a plan view of an individual pile;

FIGS. 8A and 8B show details of the mechanical locking mechanism;

FIG. 10 is a plan view of the front portion of an alternative pile; and

FIGS. 11, 12 and 13 are, respectively, schematic side elevation, plan and sectional elevation of the rear framework of a third embodiment of the present invention.

Figure 9:
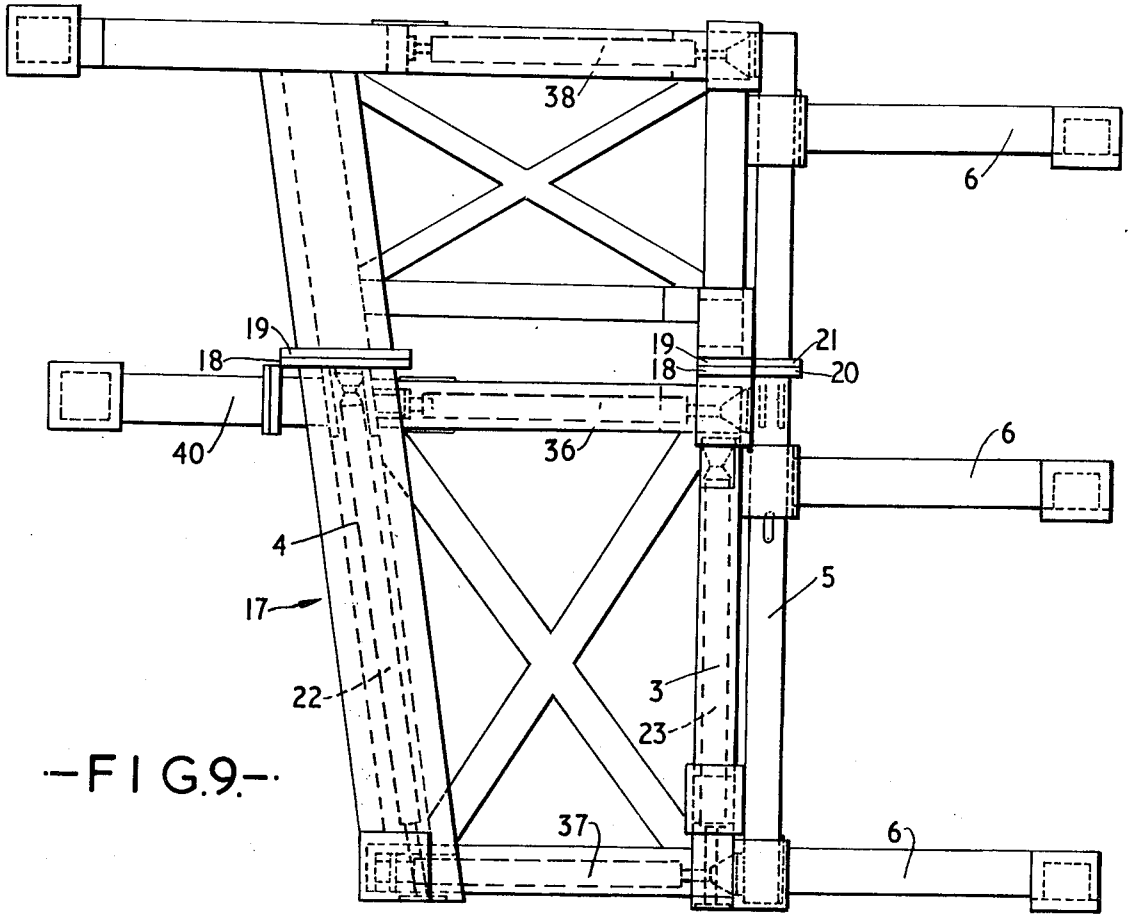
FIG. 9 shows a side elevation of part of a second embodiment of the machine.

Referring now to FIGS. 1 to 8, these show a trench shoring machine comprising a front framework generally shown as 1 and a rear framework generally shown as 2. The front framework comprises two rearward vertical walings such as 3 one at each side of the machine and two forward walings such as 4, the latter being inclined to the vertical. These walings are joined by longitudinally extending members 4*a*and also by laterally extending members. The topmost longitudinally extending members 4*b* extend forwardly of walings 4 and a laterally extending member extends between the forward ends of members 4*b*. The rearward framework comprises forward vertical members such as 5 at each side of the machine and side elements 6 extending rearwardly from these members 5. The members 5 are joined by laterally extending bracing elements and the rearward ends of the side elements 6 are also joined by lateral bracing elements. First drive means in the form of two upper rams 7 and 8 and two lower rams 9 and 10 extend between the front and rear framework, the cylinders of the rams being secured to the front framework and the piston rods being secured to the rear framework.

A series of longitudinally extending vertically spaced piles such as 11 are arranged along each side of the frameworks and are guided for substantially horizontal sliding movement longitudinally of the frameworks by guide means similar to those described in co-pending application No. 5796/73. Each pile has its own independent ram such as 12, the rams together forming second drive means by way of which the piles can be advanced longitudinally relative to the framework. Each ram comprises a cylinder secured to the first framework and a piston rod secured to the respective pile.

As shown particularly in FIG. 7 each pile has a rearward extension 13 secured thereto by a hinge 13*a* each such extension being formed by a thin piece of plate. The hinged connection allows the machine to be turned more easily than would be the case with a rigid connection. The dimensions of the piles and the rearward extensions thereof, together with the dimensions of the rear frame are such as to delineate spaces between the rearward extensions and the respective sides of the rear framework. This relationship is shown particularly in FIG. 5 with the delineated spaces numbered as 14 and 15.

The machine has a removable top section 16, which may be secured by pins or bolts to either framework. The forward and rearward walings of the front framework each have rams such as 22 and 23 by way of which the machine may be levelled in the trench.

A mechanical locking system is provided on each one of the members 5 of the rear framework in order that all the piles may be locked to the rear framework when the piles are in their advanced positions. FIG. 8A shows the details of this locking mechanism in its released position, and FIG. 8B shows the mechanism in its locked position. For each one of the piles 11 there is a locking bolt such as 24 which is biased by a compression spring 25 into the extended position shown in FIG. 8B. In such a position it can engage a locking hole 26 in the respective pile. Each bolt is provided with rollers such as 27 mounted on the opposite ends of a pin 27*a* passing through or welded to the bolt, and the spring 25 causes the rollers to bear on inclined cam surfaces such as 28, one lying to each side of the bolt. Each cam 28 is slidable vertically with respect to the associated member 5 and all the cams 28 are linked to be moved simultaneously by means of a link rod 29. The link rod can be driven vertically by a ram 30 causing vertical movement of a pin 31 engaging a hole 32 in the link rod 29. With the link rod in its raised position the locking pins are extended as shown in FIG. 8B, while with the link rod in its lower position the locking pins are retracted as shown in FIG. 8A, so that the piles are free to move.

FIG. 1 shows the machine with the rear frame 2 in its advanced (closed) position relative to the front frame 1, the rams 7 to 10 being fully retracted and all the rams 12 for driving the piles 11 being fully retracted and hydraulically locked. The rams 7 to 10 are hydraulically locked so that the two frameworks are held in their relative positions. To effect a cutting operation the rams 12 are individually extended to drive individual piles 11 forwardly into the ground in advance of the machine, the piles being advanced in sequence from the upper part to the lower part of the machine, and being hydraulically locked in that advanced position. FIG. 2 shows the machine with most of the piles so advanced, but with the lower three pairs of piles yet to be driven forwardly. After all the piles have been driven forwardly and are hydraulically locked, they are mechanically locked to the rear framework and the hydraulic lock between the piles and the front framework is released. In this position the space between the rearward extensions from the piles and the side elements of the rear frame is delineated as shown in FIG. 5 and vertical lining elements 33 can be fitted into this space, with horizontal bracing elemts 33*a* across the trench.

The rams 7 to 10 are then extended so as to drive the front framework forwardly as shown in FIG. 3, the rear framework being held by the engagement of the piles with the trench walls. The top section 16 is carried forwards with the front framework.

The piles and the front framework are then hydraulically locked together, the mechanical lock between the piles and the rear framework released and the rams 7 to 10 are retracted in order to pull the rear framework up to the front framework as shown in FIG. 1. The frictional engagement of the piles with the earth holds the front framework in position during this operation.

The sequence described can then be repeated and on the next advance of the machine it will be seen that the rearward extensions of the piles and the rear locking frame move forwardly from the gap that had been delineated at the end of the last operation, but the presence of the vertical lining members 33 ensures that the walls of the trench are firmly supported even after the machine has advanced.

By repeating the process described a fully shored, open trench can be cut and left open behind the machine as it advances. Use of thin plates for the rearward extensions 13 from the piles is advantageous as this enables the vertical lining elements 33 to be placed as close as possible to the cut walls of the trench so that there is very little inward movement of these walls as the machine moves forwardly from the last cutting area. The extensions 13, and the side elements 6 of the rear framework, are removable so that the length of the pit that must be dug initially to house the machine may be kept as small as possible. The extensions and side elements are then fitted after the first advance of the machine.

Referring now to FIG. 9, this shows a machine wherein the front and rear frameworks are each split into upper and lower sections. In this case the upper ends of the walings 3 and 4 of the front framework of the lower section terminate in plates 18, and the lower ends of the walings of the front framework of the upper section terminate in plates 19. When properly assembled as shown in FIG. 9 the plates 19 bear on the plates 18 and the two parts are secured together by bolts (not shown) passing through the plates. Similarly the members 5 at the front of the rear frameworks have at their upper and lower ends plates 20 and 21 which are again secured together by bolts when the two sections are assembled together. The lower section has upper and lower drive rams 36 and 37 between the front and rear frameworks at each side thereof, and the upper section has drive rams such as 38 between the front and rear frameworks at each side thereof. Rams for driving the piles are provided on both the upper and lower sections in a manner similar to that already described, and means for mechanically locking the piles to the rear framework are also provided.

The machine as shown in FIG. 9 may be operated without the upper section and either with or without a top section 16. However in these cases, it is necessary to include a laterally extending member which extends between forward extensions 40 of the topmost longitudinally extending members of the front framework. This laterally extending member serves to give rigidity to the machine in the absence of the upper section.

In either case the top section 16 may be removed for the remainder of the machine to be advanced below service pipes or cables which may be close to the ground. In the machine shown in FIG. 9, the upper section may be removed in addition to the top section. After any service cable or pipe has been negotiated the removed sections may once again be fitted and work recommenced in the full depth of the trench.

Referring to FIG. 10, an alternative pile which may be used with a trench shoring machine in accordance with the present invention is similar to the pile shown in FIG. 7 except with regard to the front portion thereof. Thus instead of the front portion being integral with the rest of the pile, in this case front portion 51 is connected to the rear portion 53 of the pile 11 by means of a hinge 55 allowing pivotal movement of front portion 51 about a vertical axis through the hinge. This pivotal movement may be controlled by means of a threaded tube 57 which extends into front portion 51 and is in threaded engagement with a nut 59 hingedly fixed within front portion 51. Tube 57 rotates on rod 58*a* and is retained by collar 58*b*. Rod 58*a* is hingedly fixed to the pile by means of hinge pin 58 located in the rear portion 53 of the pile. Threaded tube 57 may be turned using integral nut 61 in order to rotate front portion 51 about hinge 55. The orientation of the front portions of the piles may each be adjusted manually or actuating means may be provided to turn the front portions of the piles together or separately. By imparting a degree of pivotal movement to the front portions of the piles the direction of forward movement of the machine may be adjusted during operation.

Referring now to FIGS. 11, 12 and 13, these show the side and rear part of a rear framework for a third embodiment of a trench shoring machine according to the present invention. The machine is generally similar to that described above in connection with FIGS. 1 to 8 but the rear part of each side of the rear framework is provided with a trench lining 61 comprising a metal plate 63 attached to side elements 65 of the rear frame by means of H-section members 67. Attached to the rear of the rear frame is a hopper 69. Hopper 69 includes front plate 71, rear plate 73 and side plates 75 and 77. The top of the hopper is open and the bottom of the hopper is shaped to provide a semi-circular cut out portion to accommodate a pipe section. The bottom of the hopper is open as is also the rear portion below rear wall 73. As is illustrated by the arrows in FIG. 11 granular material may be fed into the top of the hopper so that it emerges from the hopper and surrounds the pipe section. The rear section of lining 61 is provided with an inner plate 79 so that further granular material may be fed into this rear portion of the lining where it emerges at the same level as the lowest part of hopper 69. This further granular material will fill the void which would otherwise be left as a result of forward movement of the lining member (with the rear framework) relative to the pipe section.

Located in front of hopper 69 is a steel sheet 81 being generally arch-shaped and mounted for sliding movement over the top of the pipe section. Sheet 81 is moveable by a small amount in any direction and is in fact freely mounted for such movement although it could alternatively be powered by a hydraulic ram. The purpose of this sheet 81 is to close the gap between the base of front wall 71 of the hopper and the pipe section. Such a gap is necessary to allow lateral and vertical movement of the machine relative to the pipe, and sheet 81 is accordingly provided to retain the granular material in position over and around the pipe section.

The operation of this trench shoring machine is basically similar to that described above with reference to FIGS. 1 to 8 but in this case there is no necessity to shore up the sides of the trench as the machine advances. Thus the lining 61 which is attached to the sides and ends of the rear framework allows a pipe section to be laid behind the piles but within the confines of the rear framework. Having fitted a pipe section, it may be surrounded with granular material fed down hopper 69 and the rear portion of the lining.

As shown in FIGS. 1 to 3, a trench shoring machine in accordance with the present invention, may be provided with one or more slidable lateral struts 91 across the top of the removable top section. Such struts give added rigidity to the top section of the machine and also may be moved longitudinally to allow a mechanical digger to have good access to clear earth from between the sides of the machine.

With either of the above described embodiments, the width of the machine can be easily adjusted. Thus, the laterally extending members, which are bolted to flanged stub members on the side elements of the frameworks, may be replaced by shorter or longer laterally extending members. Alternatively each existing laterally extending member may be lengthened by inserting on extension piece between an end of this member and its associated flanged stub member.

During the operation of either of the above described embodiments of trench shoring machines in accordance with the present invention, the front framework will, during each sequence of operation, be moved forwardly relative to both the piles and the rear framework (to the position shown in, for instance, FIG. 3). To achieve this and as described above, the rams 7 to 10 are hydraulically activated to extend these rams. It should be appreciated that, at the same time, the rams 12, which connect between the piles and the front framework, are retracted. However the retractions of these rams 12 is accomplished with their pistons freely floating within the ram cylinders, the necessary force required being provided by rams 7 to 10.

I claim:

1. A trench shoring machine comprising a front framework, a rear framework, a first drive means acting between the two frameworks for causing longitudinal advance of each framework relative to the other, a series of longitudinally extending vertically spaced piles arranged along each side of the frameworks, guide means guiding the piles for substantially horizontal sliding movement longitudinally of the frameworks, second drive means for advancing the piles longitudinally relative to the frameworks, means for locking the piles to each framework to prevent movement of the piles relative to that framework, and rearward extensions of the piles, said rearward extensions being laterally spaced from side elements at the respective sides of the rear framework to delineate spaces for receiving lining members to shore the trench sides after advance of the piles.

2. A trench shoring machine according to claim 1, wherein the lateral spacing between said rearward extensions and the side elements is such that vertically extending lining members may be inserted to shore the trench sides after advance of the piles.

3. A trench shoring machine according to claim 1 wherein the sides of the rear framework have each attached thereto one or more lining members to shore the trench sides after advance of the piles.

4. A trench shoring machine according to claim 1 wherein the first and second drive means are hydraulically operated rams.

5. A trench shoring machine according to claim 1 wherein hydraulic locking means are provided for locking the front and rear frameworks together in their relatively advanced or relatively retracted positions.

6. A trench shoring machine according to claim 1 wherein further hydraulic locking means are provided for locking the piles in their retracted and advanced positions relative to the frameworks.

7. A trench shoring machine according to claim 1 wherein a mechanical locking arrangement is provided for locking the piles to the rear framework when the piles are in their advanced position.

8. A trench shoring machine according to claim 7 wherein the locking arrangement comprises bolts spring loaded into a locking position where they engage locking holes in on the individual piles, together with mechanical means for releasing the locks by retracting the bolts against the spring liasing face.

9. A trench shoring machine according to claim 1 wherein the forward end of each pile is integral with the rest of the pile.

10. A trench shoring machine according to claim 1 wherein the forward end of each pile is arranged for pivotal movement relative to the rest of the pile and about a vertical axis.

11. A trench shoring machine according to claim 1 wherein the machine is in three sections, a lower section and a middle section which are bolted together and each having independent first and second drive means, and a top section which is pinned or otherwise simply secured to the middle section.

12. A trench shoring machine according to claim 1 wherein the machine is in two sections, a lower section including the first and second drive means and the locking means, and a top section which is pinned or otherwise simply secured to the lower section.

* * * * *